United States Patent [19]

Metrailer

[11] 4,325,815

[45] Apr. 20, 1982

[54] CATALYTIC FLUID COKING AND GASIFICATION PROCESS

[75] Inventor: William J. Metrailer, Baton Rouge, La.

[73] Assignee: Exxon Research & Engineering Co., Florham Park, N.J.

[21] Appl. No.: 183,435

[22] Filed: Sep. 2, 1980

[51] Int. Cl.[3] ..... C10G 9/28

[52] U.S. Cl. ..... 208/127

[58] Field of Search ..... 208/127, 46

[56] References Cited

U.S. PATENT DOCUMENTS

| | | | |
|---|---|---|---|
| 2,741,549 | 4/1956 | Russell | 208/127 |
| 2,885,350 | 5/1959 | Brown | 208/127 |
| 3,537,975 | 11/1970 | Blaser | 208/50 |
| 3,726,791 | 4/1973 | Kimberlin, Jr. | 208/127 |
| 3,803,023 | 4/1974 | Hamner | 208/46 |
| 4,269,696 | 5/1981 | Metrailer | 208/127 |

*Primary Examiner*—T. M. Tufariello

*Attorney, Agent, or Firm*—Marthe L. Gibbons

[57] ABSTRACT

An integrated catalytic fluid coking and gasification process is provided in which a portion of the coke produced in the coker is steam gasified to produce a hydrogen-containing gas and a catalytic partially gasified coke. Subsequently, a portion of the catalytic partially gasified coke is burned to provide heated partially gasified coke which is recycled to the gasification zone. A portion of the catalytic partially gasified coke is passed from the gasification zone to the coker to contact the coker vapor phase product comprising normally liquid hydrocarbons and to crack at least a portion of the normally liquid hydrocarbons. Optionally, solid fines recovered from the gaseous effluent of the gasification zone may be recycled to the carbonaceous chargestock of the coker.

19 Claims, 2 Drawing Figures

CATALYTIC FLUID COKING AND GASIFICATION PROCESS

BACKGROUND OF THE INVENTION

1. Field of the Invention

This invention relates to an integrated catalytic fluid coking and gasification process.

2. Description of the Prior Art

It is known to produce normally liquid hydrocarbons and fuel gases by integrated fluid coking and gasification processes such as those disclosed in U.S. Pat. Nos. 3,661,543; 3,702,516 and 4,055,484, the teachings of which are hereby incorporated by reference.

U.S. Pat. No. 3,803,023 and U.S. Pat. Nos. 3,726,791 disclose integrated coking and gasification processes in which a hydrogen-rich gas is produced by steam gasification of coke.

U.S. Pat. No. 3,537,975 discloses a combination catalytic cracking and fluid coking process. Heavy catalytic cracking fractionator bottoms are cracked in a transferline. The effluent of the transferline is discharged into the upper part of the coking reactor.

It has now been found that gasification of a portion of the coke produced in the coking zone each time it passes through the coking zone generates a catalytically active coke which provides advantages that will become apparent in the ensuing description.

SUMMARY OF THE INVENTION

In accordance with the invention there is provided, an integrated coking and gasification process which comprises the steps of: (a) reacting a carbonaceous chargestock in a coking zone containing a bed of fluidized solids maintained at fluid coking conditions to produce a vapor phase product including normally liquid hydrocarbons, and coke, said coke depositing on said fluidized solids; (b) reacting a portion of said solids with a coke deposit thereon with steam in a gasification zone maintained at gasification conditions to produce a catalytic partially gasified coke having a high surface area, and a gaseous stream comprising hydrogen; (c) recycling a first portion of said catalytic partially gasified coke resulting from step (b) to contact said vapor phase product of step (a) and thereby catalytically crack at least a portion of said normally liquid hydrocarbons; (d) reacting a second portion of said partially gasified coke resulting from step (b) with an oxygen-containing gas in a burning zone at burning conditions to burn a portion of said gasified coke and produce a gas comprising carbon dioxide and thereby heating the remaining partially gasified coke; and (e) recycling a portion of said heated remaining partially gasified coke from said burning zone to said gasification zone.

DESCRIPTION OF THE PREFERRED EMBODIMENTS

Figure 1:
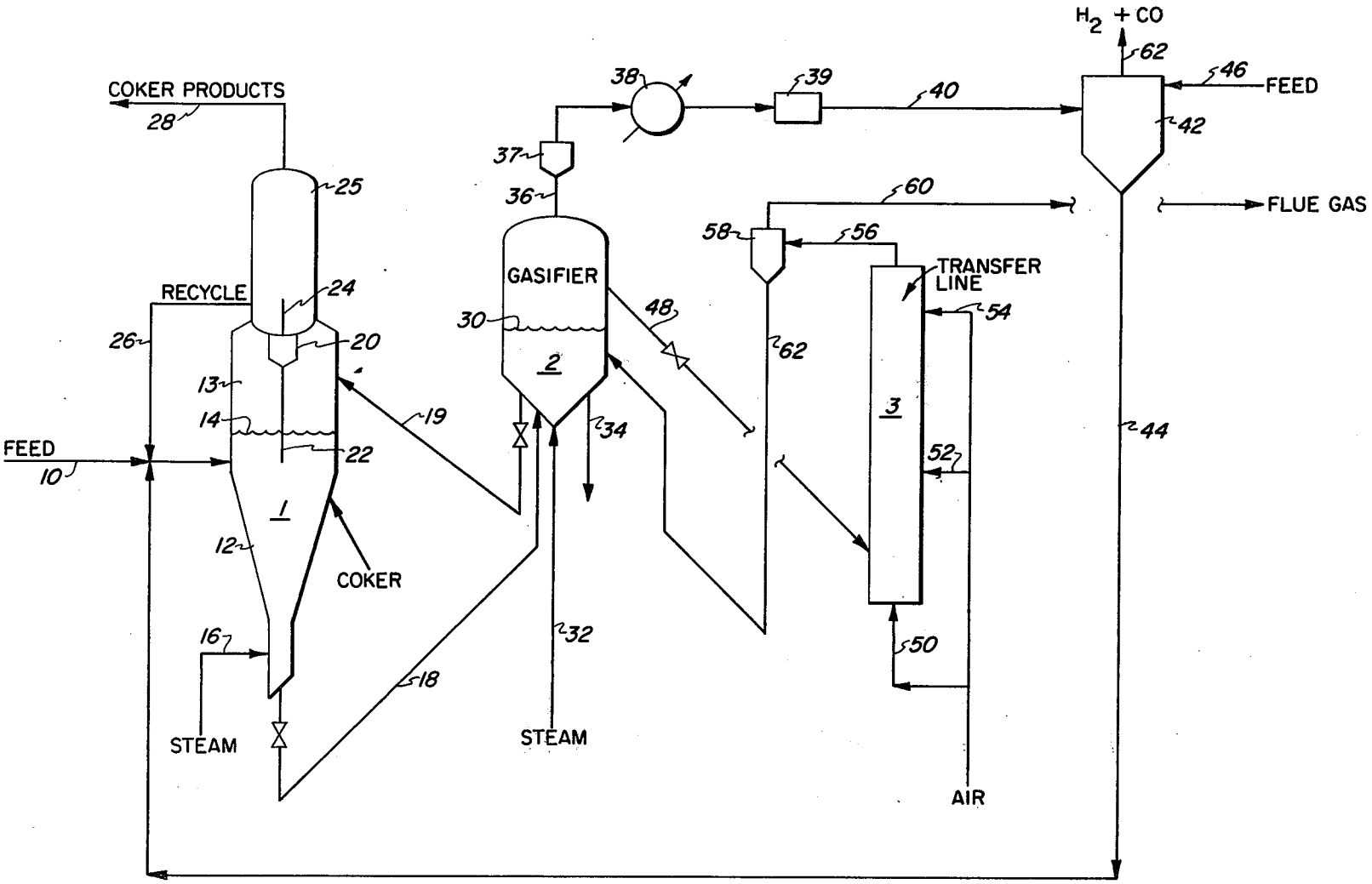
FIG. 1 is a schematic flow plan of one embodiment of the invention.

Referring to FIG. 1, a carbonaceous chargestock having a Conradson carbon residue, for example, of about 20 weight percent, such as heavy residuum having an initial boiling point (at atmospheric pressure) of about 1000° F.+ is passed by line 10 into a coking zone

Figure 2:
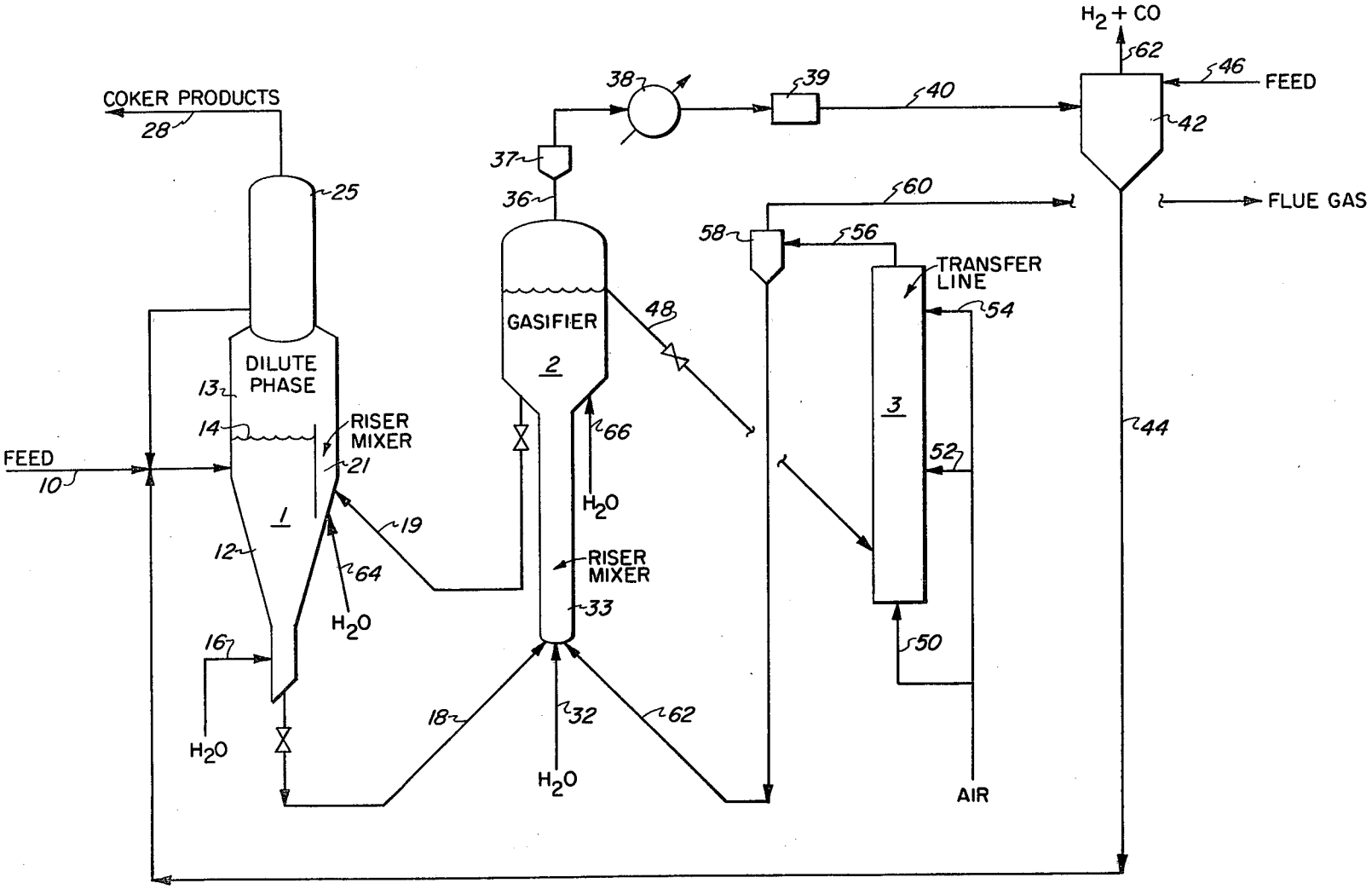
FIG. 2 is a schematic flow plan of another embodiment of the invention.

12 in which is maintained a fluidized bed of solids (e.g. coke particles of 40 to 1000 microns in size) having a level indicated at 14. Carbonaceous feedstocks suitable for coker 1 of the present invention include heavy hydrocarbonaceous oils; heavy and reduced petroleum crude oils; petroleum atmospheric distillation bottoms, petroleum vacuum distillation bottoms; pitch; asphalt, bitumens, and other heavy hydrocarbon residues; tarsand oil; shale oil; liquid products derived from coal liquefaction processes, including coal liquefaction bottoms, coal; coal slurries, and mixtures thereof. Typically, such feedstocks have a Conradson carbon residue of at least 5 weight percent, preferably above 10 weight percent (as to Conradson carbon residue, see ASTM Test D-189-65). If desired, a cracking catalyst or a gasification catalyst may be added to the feed or introduced directly into the coker. A fluidizing gas is admitted at the base of coker 1 by line 16 in an amount sufficient to obtain a superficial fluidizing velocity in the range of about 0.3 to 5 feet per second. Suitable fluidizing gases include steam, hydrogen, hydrogen sulfide, normally gaseous hydrocarbons, vaporized normally liquid hydrocarbons and mixtures thereof. Preferably, the fluidizng gas comprises hydrogen and hydrogen sulfide, for example, gaseous mixture comprising at least 5 mole percent hydrogen sulfide and 30 mole percent hydrogen. Solids at a temperature from 100 to 800 Fahrenheit degrees above the actual operating temperature of coking zone 12 are introduced by line 19 into dilute phase 13 above the dense phase fluidized bed 12 of coker 1 where they contact the vaporous product which arises from the dense fluidized bed and catalytically crack the normally liquid hydrocarbon products. The solids are injected into the dilute phase above the dense bed in such a way as to induce entrainment of the solids from the dense fluidized bed and maintain the temperature in dilute phase 13 from about 10 to about 50 Fahrenheit degrees above the temperature of the dense fluidized bed. A sufficient amount of hot solids is circulated to maintain the coking temperature in zone 12 in the range of about 850° F. to about 1400° F., preferably at a temperature ranging from about 900° F. to about 1200° F. The pressure in coking zone 12 is maintained in the range of about 0 to about 150 pounds per square inch gauge (psig), preferably in the range of about 5 to about 100 psig. The carbonaceous feed upon contact with the hot solids undergoes pyrolysis evolving lighter hydrocarbon products in vapor phase, including normally liquid hydrocarbons, and depositing a carbonaceous residue (coke) on the solids. The lower portion of the coker serves as a stripping zone to remove occluded hydrocarbons from the solids. A stream of solids having a coke deposit is withdrawn from the stripping zone of the coker by line 18 and circulated to gasifier 2. The vapor phase conversion product of the coker is passed through the dilute phase and then through cyclone 20 to remove entrained solids which are returned to coking zone 12 through dipleg 22. The coker vapor products leave the cyclone through line 24 and pass into a scrubber 25 mounted on the coker. If desired, a stream of heavy material condensed in the scrubber may be recycled to coker 1 via line 26. The coker vapor phase conversion products are removed from scrubber 25 via line 28 for fractionation in a conventional manner. In gasifier 2, stripped solids from coker 1 (cold solids) are introduced into a fluid bed of solids having an upper level indicated at 30. A steam-containing gas is introduced into gasifier 2 by line 32 to serve as fluidizing gas and to react with at least a portion of the coke deposited on the solids to produce a gas comprising hydrogen and carbon monoxide and a catalytic partially gasified coke having a highsurface area, such as for example, a surface area of at least about 100 $m^2/g$, preferably greater than about 150 $m^2/g$ and more preferably greater than about 200 $m^2/g$, based on residual coke and measured by BET. The term "catalytic" relative to partially gasified coke is used herein to designate that the partially gasified coke has catalytic cracking activity for hydrocarbons. The steam-containing gas may also comprise carbon dioxide. Preferably oxygen-containing gases, such as air or a commercial oxygen are not introduced into the gasifier, however, oxygen-containing gases may be used in start-up or for fine temperature control. The gasification zone of gasifier 2 is maintained at a temperature ranging from about 1300° F. to about 1700° F., preferably from about 1400° F. to about 1600° F. and at a pressure ranging from about 0 to about 150 psig, preferably from about 5 to about 100 psig. Preferably, the gasification is conducted at conditions to gasify above about 25 weight percent of the coke that was deposited per pass in the coker, more preferably to gasify above about 40 weight percent of the coke that was deposited on the solids in the coker per pass. A purge stream of solids may be removed by line 34. The gaseous effluent of gasifier 2 which comprises hydrogen and carbon monoxide and entrained solid carbonaceous fines is passed by line 36 through cyclone 37 and then through indirect heat exchanger 38. The gases then pass through a water gas shift zone 39 containing a sulfur tolerant water gas shift catalyst and thereafter, the gases via line 40 pass into fines separator 42 in which a portion of the entrained solid fines is separated from the gases. The fines are removed by line 44. If desired, a portion of the heavy residuum feed may be introduced into separation zone 42 by line 46 and mixed with the fines so that line 44 would contain a mixture of residuum feed and fines, which, if desired, may be recycled into residuum feed line 10. A stream of solids having a deposit of partially gasified coke is passed by line 48 to coke burning zone 3, which may be a transferline burner, as shown in FIG. 1, or a conventional coke burner having a fluidized bed of coke. A molecular oxygen-containing gas such as air or a commercial oxygen or mixtures thereof is introduced into transferline burner 3 by line 50 and, if desired, also by lines 52 and 54. The transferline burner is operated at a temperature ranging from about 212 to 572 Fahrenheit degrees (100 to 300 centrigrade degrees) above the temperature at which the gasifier is being operated to burn at least a portion of the coke that has not been gasified in the gasifier; however, some coke must remain on the solids. When coke comprises the entire circulating solids, then only about two to about ten weight percent of the coke is burned per pass. Contact of the molecular oxygen-containing gas and the coke produces a gas comprising carbon dioxide.The gas may also comprise a minor portion of carbon monoxide. Preferably the burning zone is operated such that the gaseous effluent of the burning zone will have a molar ratio of carbon dioxide to carbon monoxide of at least about 2:1, preferably greater than 10:1. The gaseous effluent of transferline 3, which comprises solids, is passed by line 56 to separator 58 such as a cyclone. A flue gas is removed from separator 58 by line 60. Solids are removed from separator 58 by line 62 and introduced into gasifier 2. Alternatively, instead of introducing the solids from separator 58 into gasifier 2, the solids from separator 58 and solids from line 18 of the coker could be introduced into a riser-mixer 33 positioned below the main section of gasifier 2, as shown in FIG. 2. Any residual hydrocarbons on the solids in line 18 are thereby preferentially cracked to hydrogen. Furthermore, the coker may comprise a riser-mixer 21 internally positioned into which solids from the gasifier may be introduced, as shown in FIG. 2, or riser-mixer external to the coker (not shown in the drawing) which may be used to mix solids from the gasifier with solids from the coker and thereby give better control of the temperature difference between the dense bed and the dilute phase. If desired, an additional stream of steam may be introduced into coking zone 12 by line 64 and a stream of steam may be introduced into gasifier 2 by line 66.

Although the process has been described for simplicity of description with respect to circulating coke as the fluidized solids, it is to be understood that the fluidized seed particles on which the coke is deposited may be silica, alumina, zirconia, magnesia, calcium oxide, alundum, mullite, bauxite and the like.

What is claimed is:

1. An integrated coking and gasification process which comprises the steps of:

(a) reacting a carbonaceous chargestock in a coking zone containing a bed of fluidized solids maintained at fluid coking conditions to produce a vapor phase product including normally liquid hydrocarbons, and coke, said coke depositing on said fluidized solids;

(b) reacting a portion of said solids with a coke deposit thereon with steam in a gasification zone maintained at gasification conditions to produce a catalytic partially gasified coke having a high surface area and a gaseous stream comprising hydrogen;

(c) recycling a first portion of said partially gasified coke resulting from step (b) to contact said vapor phase product of step (a) and thereby catalytically crack at least a portion of said normally liquid hydrocarbons;

(d) reacting a second portion of said catalytic partially gasified coke resulting from step (b) with a molecular oxygen-containing gas in a burning zone at burning conditions to burn a portion of said partially gasified coke and produce a gas comprising carbon dioxide and thereby heating the remaining partially gasified coke; and (e) recycling a portion of said heated remaining partially gasified coke from said burning zone to said gasification zone.

2. In the process of claim 1 wherein said gaseous stream resulting from step (b) comprises entrained solids, the further steps which comprise separating at least a portion of said entrained solids from said gaseous stream and recycling at least a portion of said separated solids to said carbonaceous chargestock.

3. The process of claim 1 wherein said burning zone is operated at burning conditions such that the resulting gas comprises carbon dioxide and carbon monoxide in a molar ratio of at least about 2 to 1.

4. The process of claim 1 wherein said burning zone is operated at burning conditions such that the resulting gas comprises carbon dioxide and carbon monoxide in a molar ratio greater than 10 to 1.

5. The process of claim 1 wherein said surface area of said catalytic partially gasified coke of step (b) is at least 100 $m^2/g$.

6. The process of claim 1 wherein said surface area of said catalytic partially gasified coke of step (b) is greater than about 200 $m^2/g$.

7. The process of claim 1 wherein said gasification in step (b) is conducted at conditions to gasify above about 25 weight percent of the coke that was deposited on said solids per pass in said coking zone.

8. The process of claim 1 wherein said gasification in step (b) is conducted at conditions to gasify above about 40 weight percent of the coke that was deposited on said solids per pass in said coking zone.

9. The process of claim 1 wherein said gasification conditions include a temperature ranging from about 1300° F. to 1700° F.

10. The process of claim 1 wherein said burning zone is operated at conditions such as to maintain a temperature of about 212 to about 572 Fahrenheit degrees above the actual temperature of said gasification zone.

11. The process of claim 10 wherein said burning zone is a transferline burning zone.

12. The process of claim 10 wherein said burning zone comprises a fluidized bed of solids.

13. The process of claim 1 wherein said coking conditions include a temperature ranging from about 850° to about 1400° F.

14. The process of claim 1 wherein said coking conditions include a temperature ranging from about 900° to about 1200° F.

15. The process of claim 1 wherein said carbonaceous chargestock has a Conradson carbon content of at least about 5 weight percent.

16. The process of claim 1 wherein said carbonaceous chargestock comprises a hydrocarbonaceous oil.

17. The process of claim 1 wherein said carbonaceous chargestock comprises coal.

18. The process of claim 1 wherein said gasification is conducted in the absence of added molecular oxygen-containing gas.

19. The process of claim 1 wherein said fluid coking conditions of (a) include a pressure ranging from about 0 to 150 psig.

* * * * *

UNITED STATES PATENT AND TRADEMARK OFFICE

CERTIFICATE OF CORRECTION

PATENT NO. : 4,325,815

DATED : April 20, 1982

INVENTOR(S) : William J. Metrailer

It is certified that error appears in the above—identified patent and that said Letters Patent is hereby corrected as shown below:

The title page should appear as shown on the attached sheet.

Signed and Sealed this

*Twenty-second* Day of *June 1982*

[SEAL]

*Attest:*

GERALD J. MOSSINGHOFF

*Attesting Officer*

*Commissioner of Patents and Trademarks*

United States Patent [19]

Metrailer

[11] 4,325,815

[45] Apr. 20, 1982

[54] CATALYTIC FLUID COKING AND GASIFICATION PROCESS

[75] Inventor: William J. Metrailer, Baton Rouge, La.

[73] Assignee: Exxon Research & Engineering Co., Florham Park, N.J.

[21] Appl. No.: 183,435

[22] Filed: Sep. 2, 1980

[51] Int. Cl.[3] ..... C10G 9/28

[52] U.S. Cl. ..... 208/127

[58] Field of Search ..... 208/127, 46

[56] References Cited

U.S. PATENT DOCUMENTS

| | | | |
|---|---|---|---|
| 2,741,549 | 4/1956 | Russell | 208/127 |
| 2,885,350 | 5/1959 | Brown | 208/127 |
| 3,537,975 | 11/1970 | Blaser | 208/50 |
| 3,726,791 | 4/1973 | Kimberlin, Jr. | 208/127 |
| 3,803,023 | 4/1974 | Hamner | 208/46 |
| 4,269,696 | 5/1981 | Metrailer | 208/127 |

*Primary Examiner*—T. M. Tufariello

*Attorney, Agent, or Firm*—Marthe L. Gibbons

[57] ABSTRACT

An integrated catalytic fluid coking and gasification process is provided in which a portion of the coke produced in the coker is steam gasified to produce a hydrogen-containing gas and a catalytic partially gasified coke. Subsequently, a portion of the catalytic partially gasified coke is burned to provide heated partially gasified coke which is recycled to the gasification zone. A portion of the catalytic partially gasified coke is passed from the gasification zone to the coker to contact the coker vapor phase product comprising normally liquid hydrocarbons and to crack at least a portion of the normally liquid hydrocarbons. Optionally, solid fines recovered from the gaseous effluent of the gasification zone may be recycled to the carbonaceous chargestock of the coker.

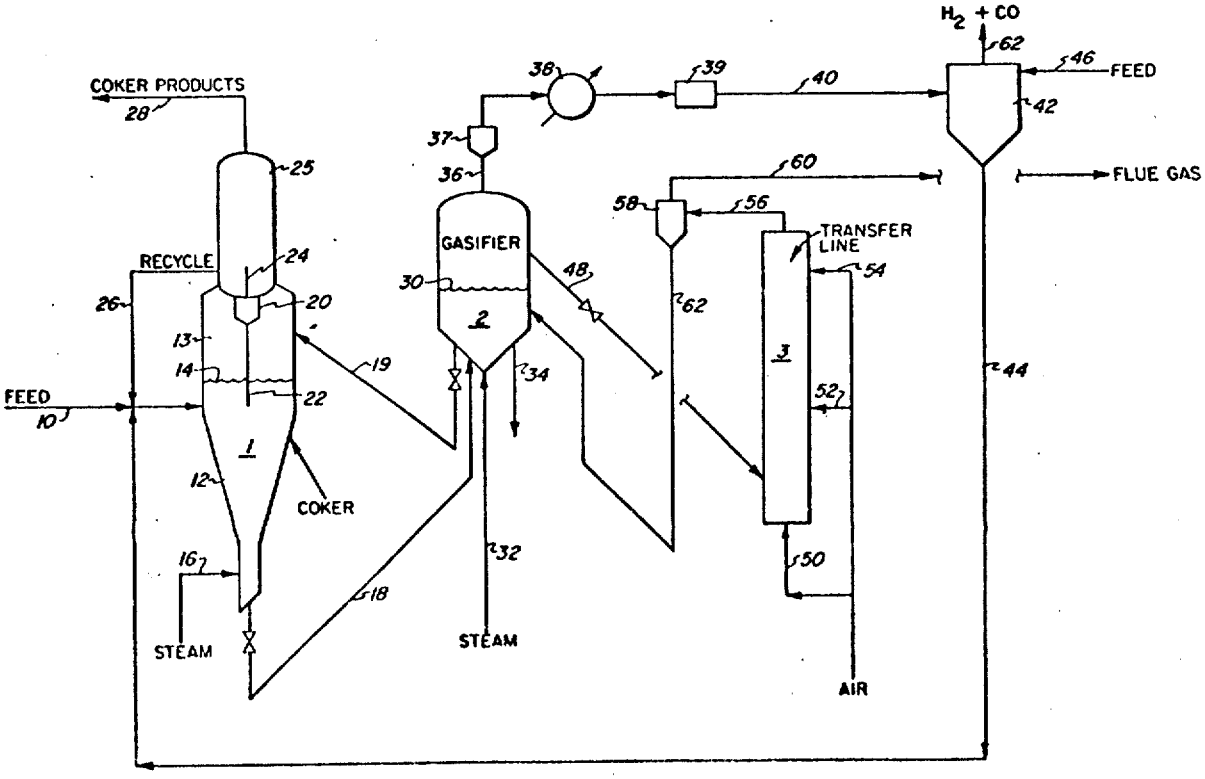

19 Claims, 2 Drawing Figures